United States Patent [19]

Ogasahara et al.

[11] Patent Number: 4,690,109

[45] Date of Patent: Sep. 1, 1987

[54] TWO-STROKE ENGINE

[75] Inventors: Takio Ogasahara, Shizuoka; Hiroaki Fujimoto, Hamamatsu, both of Japan

[73] Assignee: Sanshin Kogyo Kabushiki Kaisha, Hamamatsu, Japan

[21] Appl. No.: 777,331

[22] Filed: Sep. 18, 1985

[30] Foreign Application Priority Data

Sep. 25, 1984 [JP] Japan ..... 59-199840

[51] Int. Cl.[4] ..... F02B 33/04

[52] U.S. Cl. ..... 123/73 A; 123/73 PP

[58] Field of Search ..... 123/195 HC, 73 A, 73 B, 123/73 PP, 73 R

[56] References Cited

U.S. PATENT DOCUMENTS

| | | | |
|---|---|---|---|
| 1,035,513 | 8/1912 | Ahlberg | 123/73 B |
| 3,132,635 | 5/1964 | Heidner | 123/73 A |
| 3,730,149 | 5/1973 | Brown | 123/73 R |
| 3,859,967 | 1/1975 | Turner et al. | 123/73 R |

*Primary Examiner*—Craig R. Feinberg
*Assistant Examiner*—David A. Okonsky
*Attorney, Agent, or Firm*—Ernest A. Beutler

[57] ABSTRACT

Several embodiments of arrangements for blowing condensation from a horizontally extending portion of a transfer passage of a two-cycle internal combustion engine into the combustion chamber for improving stability of running, particularly under idle, low speed, acceleration and deceleration conditions.

8 Claims, 4 Drawing Figures

TWO-STROKE ENGINE

BACKGROUND OF THE INVENTION

This invention relates to a two-stroke engine and more particularly to an improved induction system for such an engine.

In two-cycle, crankcase compression internal combustion engines the fuel/air charge is drawn into the crankcase and is compressed during the stroke of the piston for transfer to the combustion chamber through one or more transfer or scavenge passages that interconnect the crankcase with the portion of the cylinder bore above the piston at certain phases of its stroke. Such engines have the advantages of extreme simplicity and, for that reason, are popular in many applications. However, the long path through wich the fuel/air mixture must travel before it enters the combustion chamber presents certain problems. For example, when operating at low temperatures and under certain other operating conditions, there is a tendency for a portion of the fuel to condense from the fuel/air mixture in the crankcase. If this condensed fuel is transferred into the combustion chamber through the transfer or scavenge passages, the fuel/air mixture is irregular in strength and poor running can occur. These problems are particularly acute under acceleration, deceleration or when operating at low speeds. Various devices have been proposed for transferring the condensed fuel, sometimes referred to as "drains" from the crankcase into the combustion chamber so as to insure smoother running. Although these devices have this purpose, they are not always truly effective since the drains themselves are unevenly and irregularly distributed to the combustion chamber.

The problems aforenoted are also prevalent in connection with two-cycle engines that are employed as the power unit of an outboard motor. In such applications, the cylinders are normally disposed with their axes lying in a horizontal plane and thus the transfer passages extend generally horizontally. As a result, there is always the possibility that drains or fuel condensate may accumulate in the transfer passage and be irregularly inducted into the combustion chamber. Thus, the problems aforenoted may be more pronounced with two-cycle engines employed in connection with outboard motors or other applications in which the transfer passages extend in a horizontal direction.

It is, therefore, a principal object of this invention to provide an improved induction system for an internal combustion engine.

It is another object of this invention to provide an induction system for an internal combustion engine in which condensates are not allowed to accumulate in the transfer or scavenge passages.

It is a yet further object of this invention to provide an improved induction system for a two-cycle, horizontally disposed internal combustion engine.

SUMMARY OF THE INVENTION

This invention is adapted to be embodied in a crankcase compression, two-cycle internal combustion engine having a cylinder and a crankcase. A piston reciprocates in the cylinder and a transfer passage extends between the crankcase and the cylinder for transferring a charge from the crankcase to the cylinder. The transfer passage has a horizontally extending portion in which fuel condensation may collect. In accordance with the invention, means are provided for directing a high velocity flow across the horizontally extending portion toward the cylinder for purging the horizontally extending portion of condensed fuel.

DETAILED DESCRIPTION OF THE PREFERRED EMBODIMENTS

Figure 1:
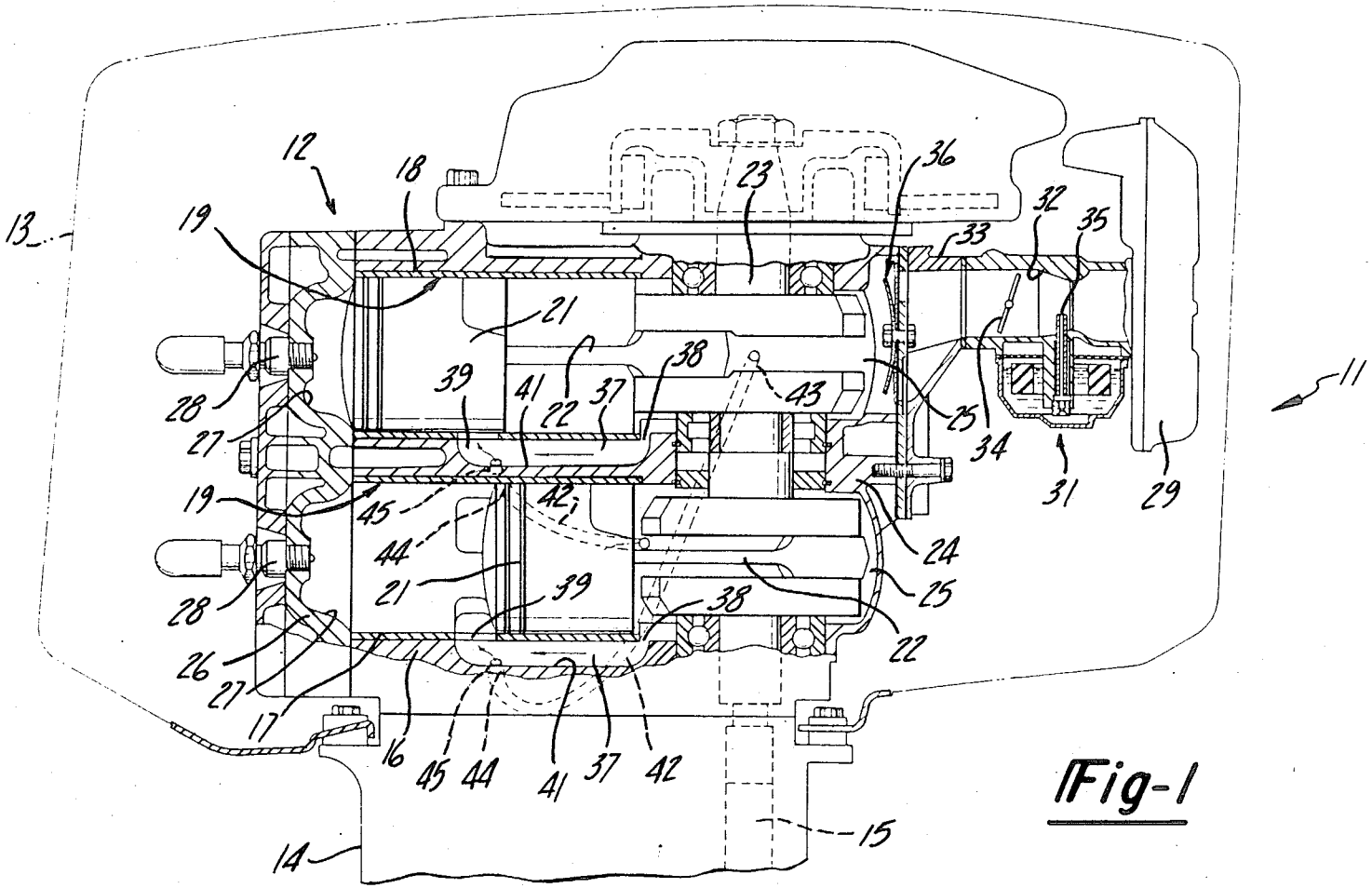
FIG. 1 is a side elevational view, with portions broken away and other portions shown in phantom, of the power head of an outboard motor having an internal combustion engine constructed in accordance with a first embodiment of the invention.

Referring first to the embodiment of FIG. 1, the power head of an outboard motor is identified generally by the reference numeral 11. The invention is described in conjunction with an outboard motor, however, it is to be understood that it may be employed with other types of applications for internal combustion engines, particularly those of the two-cycle type. An outboard motor is typical example of an environment wherein the invention has particular utility since such motors normally have their cylinders and transfer or scavenge passages extending in a horizontal direction. It is to be understood, however, that certain facets of the invention may be employed with engines having other orientations or applications.

The power head 11 includes an internal combustion engine, indicated generally by the reference numeral 12, which is surrounded by a protective cowling, which is shown primarily in phantom and which is identified generally by the reference numeral 13. The power head is, in turn, carried at the upper end of a drive shaft housing 14 that supports a drive shaft 15 for rotation about a vertically extending axis. The drive shaft 15, in turn, extends through a lower unit (now shown) so as to provide an output as is well known in this type of application. Because the invention is directed primarily to the induction system for the engine 12, other details of the outboard motor are not illustrated nor will they be described.

The engine 12 is comprised of a cylinder block 16 having cylinder liners 17 that are pressed into place and which define cylinder bores 19 that extend in a generally horizontal direction. In the illustrated embodiment, the engine 12 is of the two-cylinder, inline type. It is to be understood, however, that the invention may be employed in conjunction with engines of other cylinder configurations.

Pistons 21 are supported for reciprocation in the cylinder bores 19 and are connected by means of connecting rods 22 to drive a crankshaft 23 that is supported for rotation about a vertically extending axis. The crankshaft 23 is so supported by the cylinder block 16 and a crankcase 24 that is affixed to the cylinder block 16 in a known manner. The crankshaft 23 is drivingly coupled to the drive shaft 15 in any appropriate manner.

The cylinder block 16 and crankcase 24 provide a number of individual chambers 25 each of which is associated with the area beneath a respective piston 21. These individual crankcase chambers 25 are sealed from each other in an appropriate manner.

A cylinder head 26 is affixed to the cylinder block 16 in a known manner and defines individual recesses or chambers 27 that cooperate with the reciprocating pistons 21 to provide varying volume chambers which may be referred to as the combustion chambers. Spark plugs 28 are supported by the cylinder head 26 and have their gaps extending into the recesses 27 for firing the fuel/air charge in a known manner.

The arrangement for delivering the fuel/air charge to the combustion chambers 27 will now be described. This includes an air inlet device 29 that draws intake air from within the protective cowling 13 and which may provide some silencing for the intake. The air charge is delivered to one or more carburetors 31 that have individual induction passages 32 that supply a manifold 33 which distributes the charge to the respective crankcase chambers 25. Normally, there will be one induction passage 32 serving each crankcase chamber 25.

A throttle valve 34 is provided within the carburetor 31 for controlling the flow through the induction passage 32. A fuel discharge system including a main fuel nozzle 35 is provided by the carburetor 31 for delivering a fuel/air mixture to the manifold 33 for distribution to the crankcase chambers 25. The carburetor 31 and induction system thus far described may be of any known type. In addition, reed-type check valves 36 are provided between the manifold 33 and the crankcse chambers 25 so as to prevent return flow from the crankcase chambers 25 into the induction passages 32.

When the pistons 21 are moving upwardly in the cylinder bores 19 from their bottom dead center positions, a negative pressure will be exerted in the crankcase chambers 25 and a fuel/air charge will flow from the induction passages 32 through the check valve 36. when the pistons 21 begin their downward stroke, this charge will be compressed and it is eventually transferred to the combustion chambers 27 through one or more transfer or scavenge passages 37. The passages 37 have an inlet end 38 that communicates with the respective crankcase chambers and a discharge end or port 39 that is positioned so as to communicate with the combustion chambers 27 during a portion of the stroke of the pistons 21. Thus, a charge may flow from the crankcase chambers 25 to the combustion chambers 27 for firing by the spark plugs 28. The burnt charge is discharged thorugh suitable exhaust ports.

It should be noted that the scavenge passages 37 have horizontally extending portions 41. Fuel may condense in these horizontal portions 41 and the condensed fuel will, in a conventional engine, be discharged irregularly into the combustion chambers 27 to provide uneven running and poor running, particularly under idle, acceleration and deceleration conditions.

In accordance with this embodiment of the invention, an arrangement is provided for delivering a high velocity charge across the horizontally extending portion 41 and in a direction so as to direct any condensed fuel into the combustion chamber through the open ports 39. For this purpose and in this embodiment, a conduit 42 extends from each crankcase chamber 25 and specifically from an inlet opening 43 therein to a discharge portion 44 in which a check valve 45 may be provided of the other cylinder. The discharge opening 44 and check valve 45 are disposed adjacent the port 39 and are directed so that the high velocity charge will be directed toward the condensed fuel and inwardly through the port 39 so as to transfer the condensed fuel on a continuous basis during each cycle into the combustion chamber 27.

It should be noted that the pistons 21 of the respective cylinders operate 180° out of phase. Hence, when one chamber is on the transfer portion of the cycle as shown in the lowermost chamber, the remaining piston will beginning its downward stroke and create a compression in its crankcase chamber that will cause a high velocity charge to be delivered through the conduit 42 into the transfer passage horizontal portion 41 in a direction toward the port 39 so as to sweep the condensed fuel into the respective combustion chamber.

Figure 2:
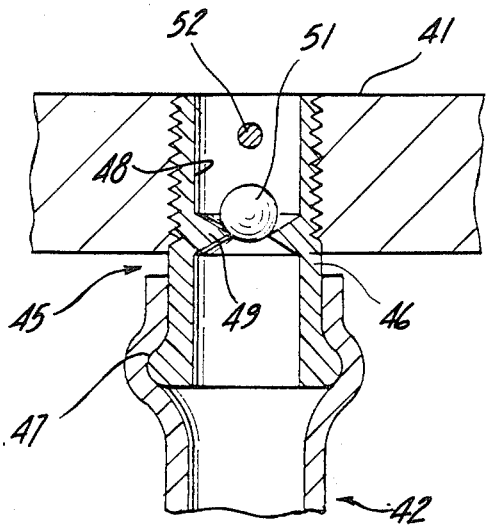
FIG. 2 is an enlarged cross-sectional view of a check valve that may be utilized in conjunction with the embodiment of FIG. 1.

FIG. 2 illustrates in detail the construction of the check valve 45. It to be understood that in some embodiments, the check valve 45 may be dispensed with depending upon the respective timing of the piston movements. However as illustrated the check valve 45 includes a main housing assembly 46 having a projection or protuberance 47 around which the end of the flexible conduction 42 is received. The housing 46 is formed with a passage 48 that extends through it and which forms a restricted opening or valve seat 49. A ball-type check valve 51 cooperates with the opening in the valve seat 49 so as to control the flow through this opening. When the pressure differential on the ball 51 exceeds its weight, the ball 51 will open and permit flow through the conduit 42 into the transfer passage 37. A pin 52 is staked into the housing 46 above the seat 49 so as to prevent the ball 51 from leaving the housing 46 without restricting its opening and closing movement.

The embodiment of FIGS. 1 and 2 is constructed so that the pressure in one crankcase chamber is employed to blow the condensate from the transfer passage associated with another crankcase chamber to its respective combustion chamber. Thus, this arrangement can be utilized in conjunction with multiple cylinder engines having cylinders that fire out of phase with each other.

Figure 3:
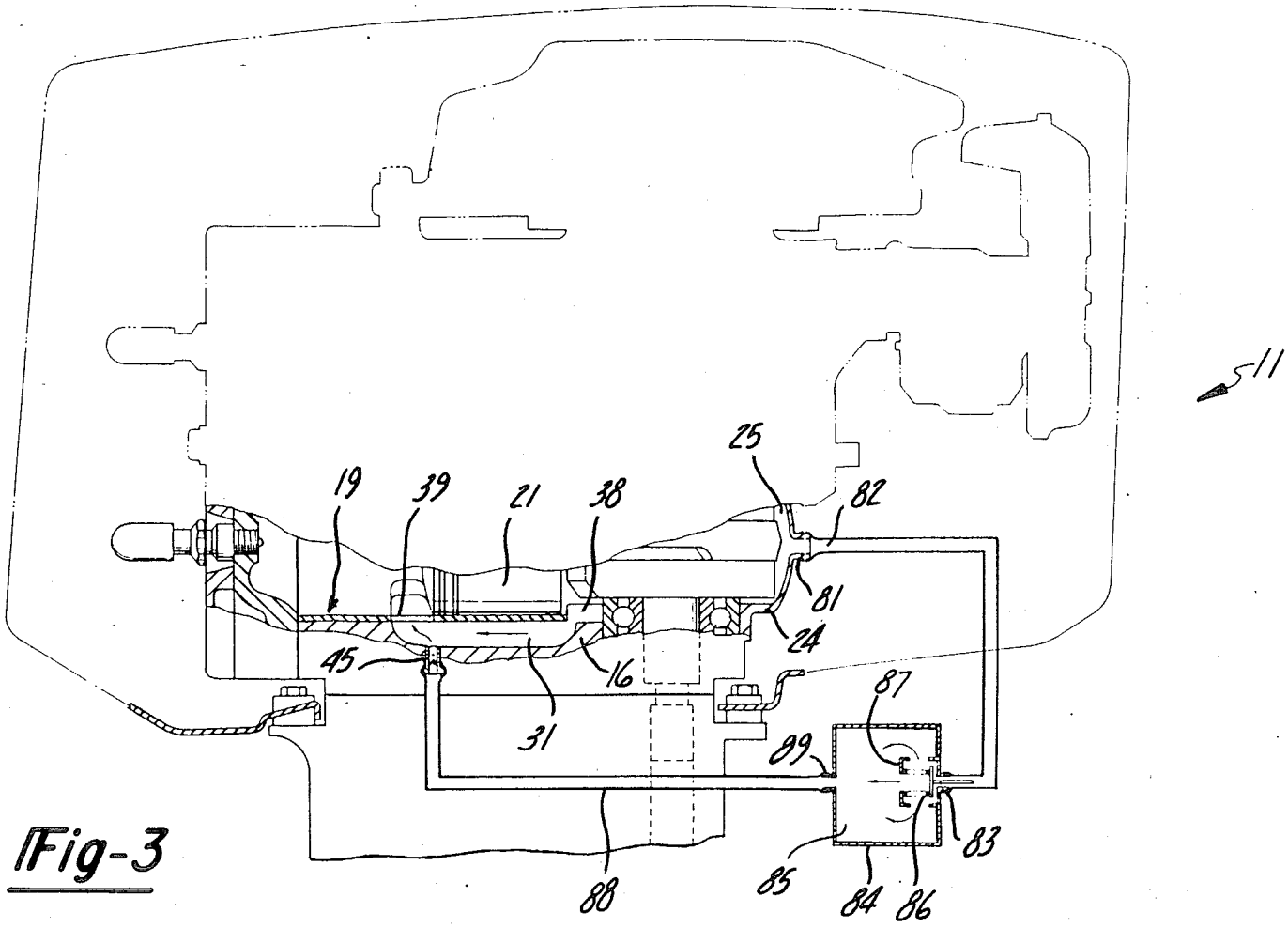
FIG. 3 is a side elevational view, in part similar to FIG. 1, showing a second embodiment of the invention.

FIG. 3 shows an embodiment, which is generally similar to the embodiment of FIGS. 1 and 2, but in which the invention may be practiced with individual cylinders so that the crankcase pressure in one crankcase chamber is employed to blow the condensate from the transfer passage associated with that same chamber. Because of this relationship and since the components of the basic engine are the same, only the construction associated with a single cylinder has been illustrated and will be described. In this description, the reference numerals applied to the basic components of the engine as used in conjunction with the embodiment of FIGS. 1 and 2 will be repeated and the description of these components will not be repeated, except insofar as is necessary to understand the construction and operation of this embodiment.

The crankcase 24 is provided with a nipple portion 81 for each of the chambers 25. A flexible conduit 82 is received on the nipple 81 at one of its ends and on a nipple 83 at its opposite end. The nipple 83 is formed as a portion of an accumulator chamber or surge tank 84 defining an internal volume 85. A pressure responsive check valve 86 is urged normally toward a closed position by a coil compression spring that acts between the check valve 86 and a retainer member 87 so that the volume 85 is not charged until the pressure in the crankcse chamber 25 exceeds the pressure necessary to open the spring acting on the check valve 86.

A further flexible conduit 88 extends from another nipple 89 of the accumulator or surge chamber 84 to the nipple provided by the check valve 45. As with the previously described embodiment, the check valve 45 communicates with the transfer or scavenge passage 37 adjacent its discharge port 39 so that the high pressure flow from the accumulator chamber 84 may enter the transfer passage 37 and sweep any drains into the combustion chamber through the port 39 at such times as the port 39 is opened and when the chamber 84 has been charged.

This embodiment acts as follows. When the charge in the crankcase chamber 25 is being compressed and the pressure is of a predetermined value, the fuel/air charge will be pressurized in the conduit 82 and the check valve 86 will open to permit the volume 85 to be charged. This charge pressure will be relieved through the check valve 45 when the port 39 is opened so as to sweep the condensed fuel into the combustion chamber as aforenoted. The check valves 45 and 86 act, however, to prevent reverse flow.

Figure 4:
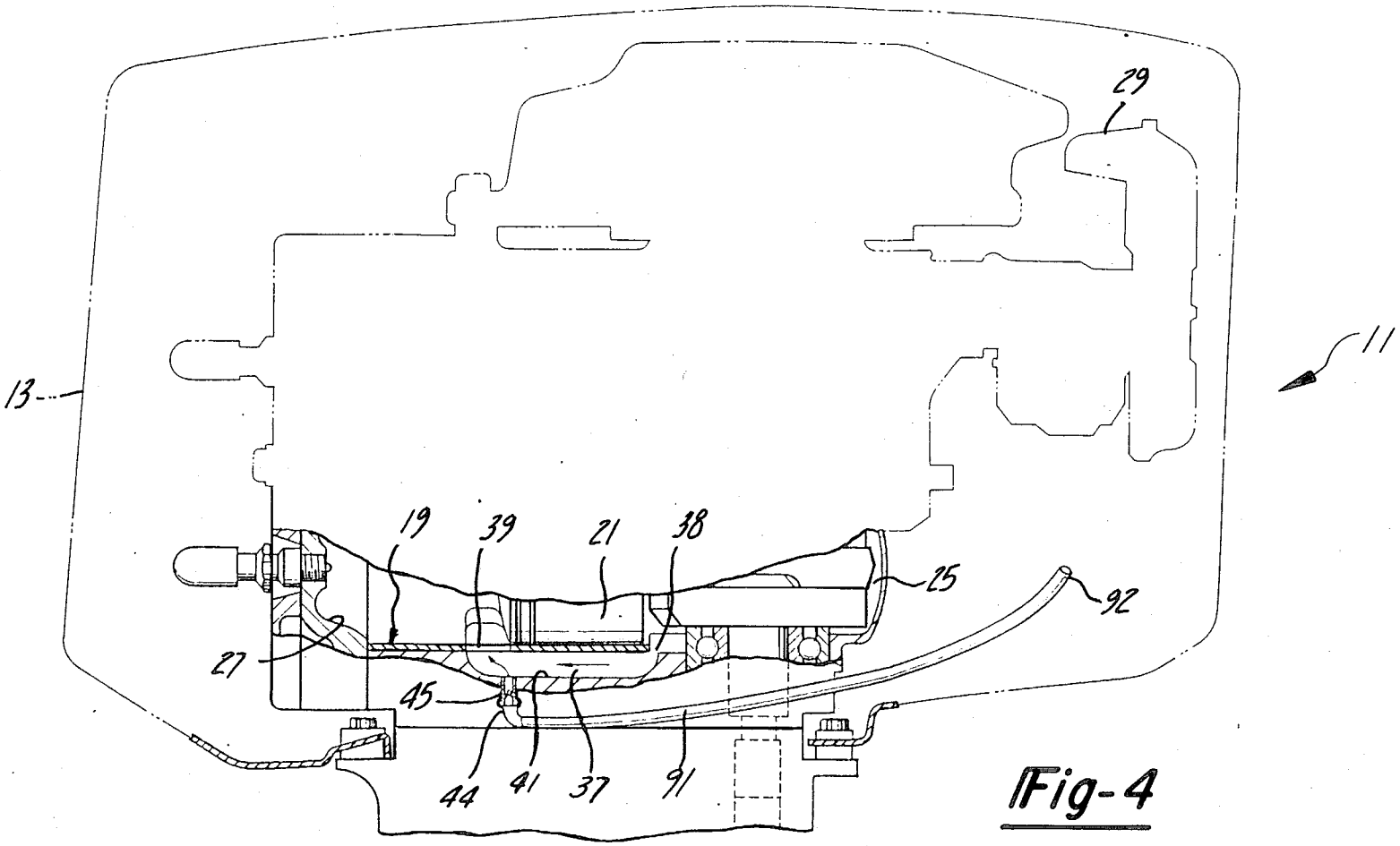
FIG. 4 is a side elevational view, in part similar to FIGS. 1 and 3, showing yet a further embodiment of the invention.

In the two embodiments thus far described, the pressure from a crankcase chamber has been employed to blow the drains or condensates from the transfer passage into the combustion chamber. FIG. 4 shows an embodiment wherein the crankcase pressure is not employed for this purpose but, rather, atmospheric air is utilized for this purpose. Thus, this embodiment may be used with either single or multiple cylinder engines having any firing orders.

Referring now specifically to FIG. 4, the construction of the basic engine including the transfer passages is the same as in the preceding embodiments and, for that reason, the components which are the same as the earlier embodiments have been identified by the same reference numerals. In this embodiment, a flexible conduit 91 extends from the check valve 45 and has an end 92 that is opened to atmospheric air. This opening may be either within the general confines of the protective outer cowling 13 or within the air inlet device 29 or at any other appropriate location. Hence, the conduit 91 and check valve 45 downstream of its valve element will be exposed to atmospheric air pressure. When the piston 21 is on its upward stroke and at a time when the transfer port 39 is still open, the pressure in the combustion chamber 27 will at times be less than atmospheric. Thus, under this condition, the check valve 45 will open and atmospheric air will flow from the conduit 91 into the transfer passage 37 to blow any condensate formed therein into the combustion chambers 27 through the open port 39.

It should be readily apparent that each of the described embodiments is highly effective in insuring good running under all conditions since any fuel that condenses in the horizontally extending portion of the transfer passage will be blown into the combustion chamber so that uniform fuel/air mixture will be encountered in each cycle of operation. Although several embodiments of the invention have been illustrated and described, various changes and modifications may be made without departing from the spirit and scope of the invention, as defined by the appended claims.

We claim:

1. in a crankcase compression, two-cycle internal combustion engine having a cylinder and a crankcase, a piston reciprocating in said cylinder and a transfer passage extending between said crankcase and said cylinder for transferring a charge from said crankcase to said cylinder, said transfer passage having a horizontally extending portion defined by a lower horizontal wall upon which fuel condensation may collect, the improvement comprising separate conduit means for directing a high velocity flow along and intersecting said horizontal wall towards said cylinder for purging said horizontal wall of condensed fuel.

2. In a crankcase compression, two-cycle internal combustion engine as set forth in claim 1 wherein there are a plurality of cylinders and crankcases with respective transfer passages, the conduit menas communicating the crankcase chamber associated with one cylinder with the transfer passage of another cylinder and wherein the pistons are out of phase with each other.

3. In a crankcase compression, two-cycle internal combustion engine as set forth in claim 2 further including check valve means for precluding reverse flow through the conduit means.

4. In a crankcase compression, two-cycle internal combustion engine as set forth in claim 1 wherein the conduit means communicates at one end with the atmosphere.

5. In a crankcase compression, two-cycle internal combustion engine as set forth in claim 4 further including a check valve in the conduit means for preventing reverse flow from the transfer passage to the atmosphere.

6. In a crankcase compression, two-cycle internal combustion engine as set forth in claim 1 wherein the high velocity flow is delivered from the crankcase associated with the respective cylinder through the conduit means.

7. In a crankcase compression, two-cycle internal combustion engine as set forth in claim 6 further including an accumulator chamber interposed in the conduit means.

8. In a crankcase compression, two-cycle internal combustion engine as set forth in claim 7 further including check valve means between the accumulator chamber and the transfer passage for precluding reverse flow through the conduit means.

* * * * *